United States Patent [19]

Preisig

[11] 4,038,909

[45] Aug. 2, 1977

[54] METHOD AND APPARATUS FOR COUNTING A PLURALITY OF FOLDED BOX BLANKS IN A STREAM OF BOX BLANKS AND SEPARATING THE COUNTED BLANKS AS A BATCH

[75] Inventor: Roland Preisig, Yens, Switzerland

[73] Assignee: J. Bobst & Fils, S.A., Switzerland

[21] Appl. No.: 657,612

[22] Filed: Feb. 12, 1976

[30] Foreign Application Priority Data

Feb. 21, 1975 Switzerland ..... 2222/75

[51] Int. Cl.[2] ..... B31B 1/98

[52] U.S. Cl. ..... 93/93 M; 93/93 C

[58] Field of Search ..... 93/93 C, 93 DP, 93 D, 93/93 R; 271/149, 150, 151, 214; 214/7

[56] References Cited

U.S. PATENT DOCUMENTS

| | | | |
|---|---|---|---|
| 3,013,292 | 12/1961 | McCormick et al. | 93/93 R X |
| 3,391,806 | 7/1968 | Geis et al. | 93/93 C X |
| 3,399,788 | 9/1968 | Heywood et al. | 93/93 C |
| 3,420,149 | 1/1969 | Middleditch et al. | 271/214 X |
| 3,948,153 | 4/1976 | Dutro et al. | 93/93 C |

*Primary Examiner*—James F. Coan

*Attorney, Agent, or Firm*—Hill, Gross, Simpson, Van Santen, Steadman, Chiara & Simpson

[57] ABSTRACT

A method and apparatus for counting a predetermined number of folded box blanks which are disposed on edge in a continuous flow and for separating the predetermined number of box blanks from the flow as a batch characterized by holding the flow immobile, moving a counting device from one end of the flow low and the other end, stopping the counting as a predetermined number of blanks has been counted, holding a blade of the counting device between the last counted blank and the next following blank, moving the flow toward the one end with the counting device moving with the flow, stopping the movement of the flow as the counting device reaches a predetermined position, moving a separating means between the last counted blank and the next preceeding blank to separate the counted blanks as a batch.

25 Claims, 5 Drawing Figures

METHOD AND APPARATUS FOR COUNTING A PLURALITY OF FOLDED BOX BLANKS IN A STREAM OF BOX BLANKS AND SEPARATING THE COUNTED BLANKS AS A BATCH

BACKGROUND OF THE INVENTION

The present invention is directed to a method and an apparatus for counting a predetermined number of folded box blanks which are disposed on edge in a continuous flow and for separating the predetermined number of box blanks from the flow as a batch.

In the manufacture of boxes or cartons, the carton or box is folded into a flatened condition for subsequent handling such as shipping to a customer. These flatened cartons or boxes are arranged in stacks that are inserted in the cardboard containers for shipping.

In handling the folded cartons or boxes, known devices erect the blanks into a continuous stream or flow with the blanks on edge, separate a batch of blanks from the stream and subsequently place the batch in a cardboard container. One of the principle problems of the known devices is that an exact count of the folded boxes in each of the batches is unknown.

SUMMARY OF THE INVENTION

The present invention is directed to a reliable method and apparatus for accurately counting a predetermined number of folded box blanks which are disposed on an edge in a continuous flow and for separating the predetermined number of box blanks from the flow as a batch for subsequent handling. To accomplish this aim, the method comprises providing a track means for receiving and supporting a flow of the folded box blanks disposed on their edges and having a first and second end, separating device at the second end of the track means and movable from a first position extending across the second end to prevent discharge of the box blanks therefrom and a second position enabling discharge of the box blanks and a counting head having means including a counting blade for counting folded box blanks and creating a signal; introducing a flow of box blanks into the first end of the track means; positioning the separating device to prevent discharge of the box blanks from the second end; moving the counting head from a first position adjacent the separating device towards the first end to sequentially count blanks in the flow contained therein; stopping movement of the counting head when a predetermined number of box blanks has been counted; holding the blade of the counting means inbetween the last counted blank and the next following blank; moving the separating means to the second position; moving the flow in the track means with the counting head moving therealong to discharge the counted blanks as a batch from the second end; stopping the movement of the flow as the counting head reaches the first position; moving the separating means to the first position extending between the last counted box blank and the next following blank to separate the batch from the flow; releasing the blade and moving the counting head toward the first end to count the next succeeding batch of blanks.

An apparatus for accomplishing the above method includes a frame, track means disposed in the frame for receiving and supporting the flow of folded box blanks, said track means having a first and second end and including means for conveying the flow along the track means from the first to the second end; means disposed in the frame for introducing the flow of folded box blanks disposed on an edge into the first end of the track means; means disposed adjacent the second end to receive the batch of box blanks a separating device disposed at the second end of the track means; means for shifting the separating device between a first position extending across the second end to prevent discharge of the box blanks into the means for receiving and a second position enabling discharge of the box blanks from said second end; a counting head having means including a counting blade for counting the folded box blanks and creating a signal, and means for selectively holding the blade between two blanks; means for supporting said counting head for movement along said track means from a first position adjacent the second end with an end of the blade in the path of the separating device to a second position displaced toward the first end of the track means; means for moving the counting head on said means for supporting; sensing means mounted on the frame for creating a signal when the counting head is in said first position; and control means for receiving the signals from the counting means and the sensing means and actuating the means for shifting, the means for conveying, the means for moving, and the means for holding in response to the particular signal received.

Preferably, the apparatus includes a means for sensing the alignment of the box blanks introduced into the track means and for correcting the position of the blanks. The means for correcting includes a shoe member and means for reciprocating the shoe member against edges of the blanks.

Preferably, the means for introducing includes means for erecting folded box blanks in a shingle-wise arrangement into the flow of box blanks disposed on an edge. The means for erecting preferably includes at least an upper and lower conveyor belt, a presser member engaging the upper belt to deflect the path of the belt below the upper edge of the flow to facilitate erecting of the blanks into the flow and to apply a pushing pressure thereto.

The counting means includes a piezoelectric transducer which is engaged by a protruberance on the counting blade which is flexible so that oscillations of the blade are applied to the piezoelectric transducer which creates signals applied to the counting means.

The holding means includes a stiff blade pivotably mounted on the head and urged into engagement with a rod of a pneumatic piston so that actuation of the piston causes the stiff blade to engage the flexible blade of the counting means and hold it with an end disposed between a pair of box blanks.

DESCRIPTION OF THE PREFERRED EMBODIMENT

Figure 1:
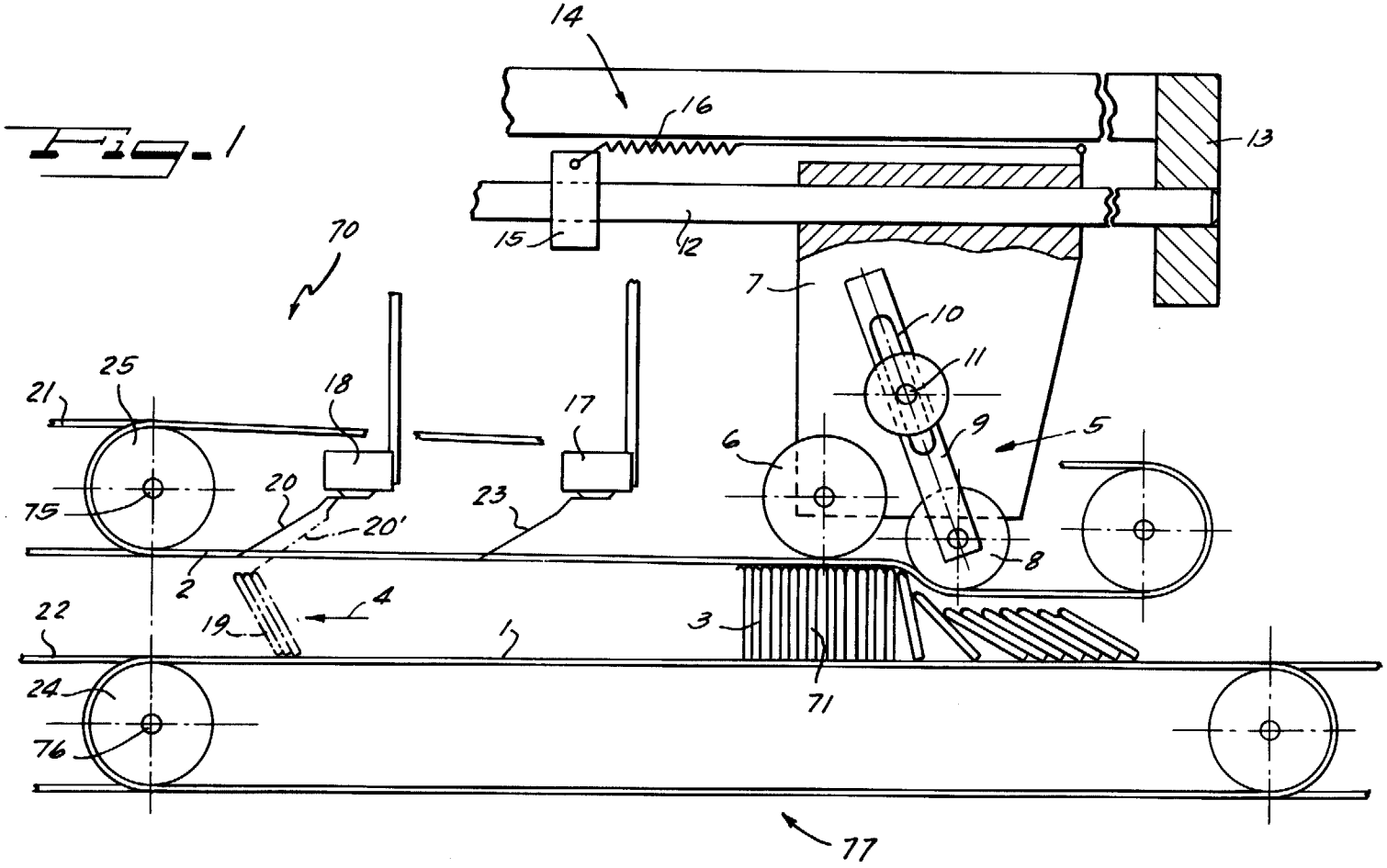
FIG. 1 is a diagrammatic side view with portions in cross section and portions broken away for purposes of illustration of the introducing means in accordance with the present invention.

The principles of the present invention are particularly useful when incorporated in an apparatus generally indicated at 70 in FIGS. 1 and 2, for counting a plurality of folded box blanks 3 in a stream or flow 71 of box blanks and subsequently separating the counted blanks as a batch 49.

The apparatus 70 (FIG. 2) has track means generally indicated at 72 which is formed by at least one upper conveyor belt 21 coacting with at least one lower conveyor belt 22. The track means 72 has a first end which is defined by pulleys 26 and 27 of the belts 21 and 22 and a second end which is defined by pulleys 73 and 74. Pulley 26 is supported for rotation on a shaft 75 while the pulley 27 is supported for rotation on a shaft 76. The first end of the track means 72 is an inlet end for the track means and the device 70 includes introducing means generally indicated at 77 (FIG. 1) which is defined by at least one lower belt 1 coacting with at least one upper belt 2. The belt 1 has a pulley 24 which is rotatably supported on the shaft 76 and the belt 2 has a pulley 25 rotatably supported on the shaft 75.

The belts 1 and 2 of the introducing means 77 moves the flow 71 in a direction of arrow 4 into the track means 72 with each blank 3 being disposed in an upright position on an edge. The introducing means 77 also includes means for erecting the folded box blanks 3 which are in a shingle-wise arrangement into the upright vertical position of the flow.

The means for erecting includes a pressing device generally indicated at 5 (FIG. 1) which presses the blanks in the direction of the arrow 4. The pressing device 5 includes a roller 6 which is mounted on a support 7 so it is able to rotate freely. A pressing roll 8 is mounted to rotate freely on an arm 9. The arm 9 has a slot-like aperture 10 which receives a stud or bolt 11 that mounts the arm 9 for pivotal movement on the support 7. The arm 9 can thus pivot and shift freely with the limits of shifting being determined by the length of the aperture 10 and can enable the position of the pressing roll 8 to be moved along the upper conveyor 2 in accordance to the number of folded box blanks 3 in the flow. 71. As illustrated, the roll 8 engages a portion of the belt 2 to deflect it to a level lower than the level of the belt engaging the upper edges of the blanks 3 in the flow 71.

The support 7 is mounted for sliding movement on an axle or rod 12, which is part of a setting or sub-frame 13, that is vertically adjusted within the main frame of the device 70. The sub-frame 13 also supports the various pulleys such as 26 and 73 of the upper belt 21 of the track means 72 and the pulleys for the upper belts 2 of the introducing means 77. Thus, vertical movement of the sub-frame 13 within the main frame of the apparatus 70 enables adjusting the distance between the conveyor belts 1 and 2 and the belts 21 and 22, respectively, to enable handling folded box blanks 3 having different sizes.

To maintain the pressing device 5 in permanent contact with the flow of blanks and to maintain the roller 8 in a position applying a force in the direction of arrow 4 on the blanks being erected into the flow, a pull-back device generally indicated at 14 biases the support 7 in the direction of arrow 4. The pullback device consists of a ring 15 adjustably secured on the shaft or axle 12 and a spring 16 having one end attached to the end 15 and the other end attached to the support 7. Thus, the pullback device will compensate for changes in the length of the flow 71 which changes will occur during the operation of the apparatus 70.

In order to ensure that all of the box blanks 3 of the flow or stream 71 are disposed in the vertical or upright position, the introducing means 77 includes a pair of safety contacts or sensing devices 17 and 18 which are adjustably mounted on the subframe 13. The devices 17 and 18 are spaced along the flow 71 with the amount of the space being adjustable and representing the length of a batch of blanks which is being formed in the apparatus 70. The safety contact 18 has a blade or actuator 20 which will move along an upper edge of the flow 71. In a similar manner, the safety device 17 has an actuator or blade 23. If one or more of the blanks fail to assume the vertical position and thus assumes a position illustrated in dot dash lines by blanks 19, the blade such as 20 of the safety contact 18 will fall to a position 20'. When the blade 20 drops to the position 20', the safety contact 18 will disengage the drive of the conveyors 21 and 22 to stop these conveyors. With the conveyor belts 21 and 22 stopped, the conveyor belts 1 and 2 will continue to move the blanks 3 disposed therebetween against the stationary portion of the flow 71 in the track means 72 and this continued movement will return the blanks back to the upright position. Safety contact 17 will function in the same manner. However, in order to drive the conveyors 21 and 22 of the track means 72, both the blades 20 and 23 of the contact means 17 and 18 must be in the initial raised position. Thus, if either of the blades 20 or 23 drops to a lower position, the conveyor belts 21 and 22 will be stopped.

Figure 2:
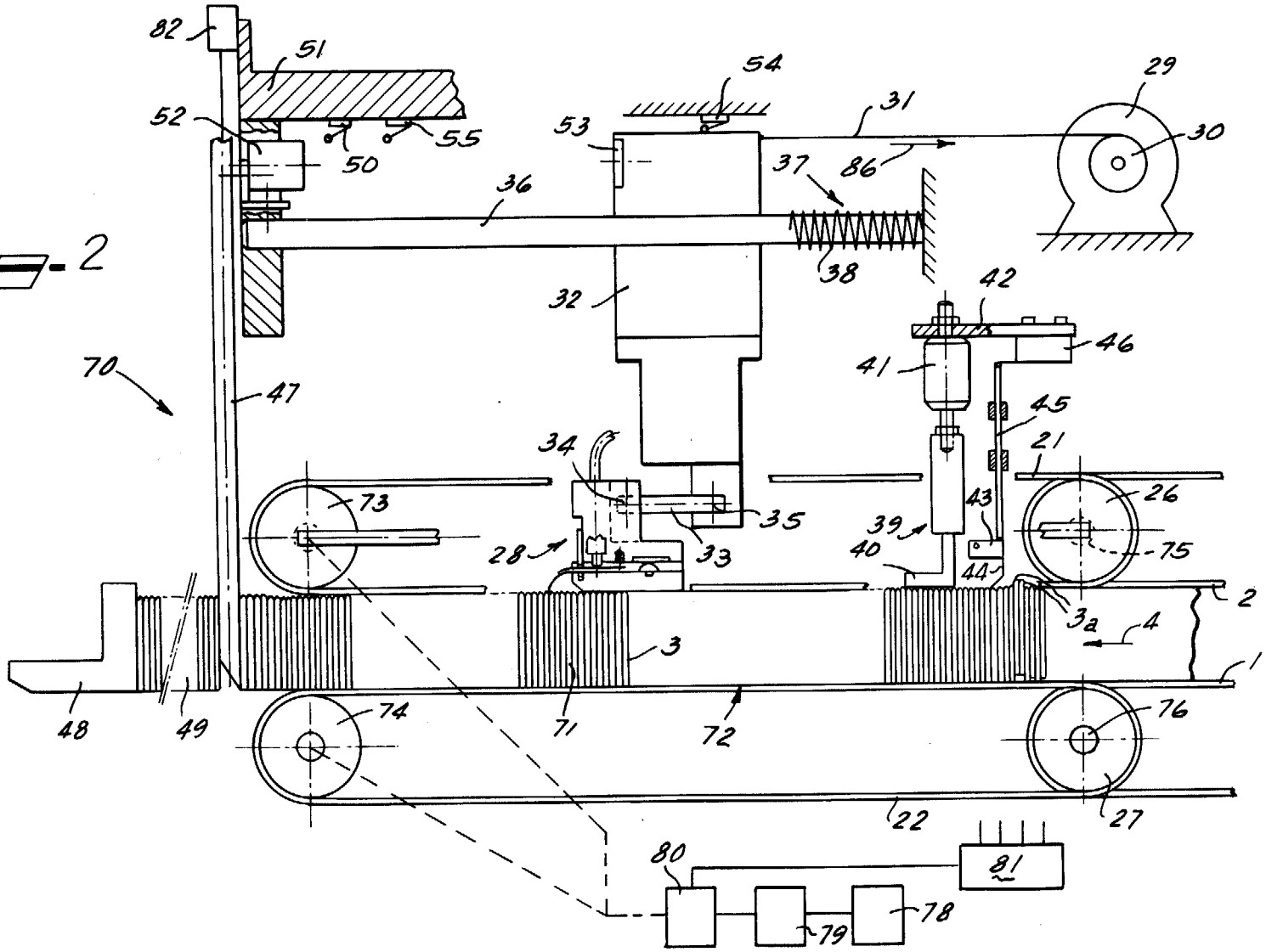
FIG. 2 is a diagrammatic side view with portions broken away and in cross section for purposes of illustration of the track means and counting means in accordance with the present invention.

As best illustrated in FIG. 2, each of the belts 21 and 22 are driven by a drive means which enables stopping the movement of the belts during a counting phase. For example, the belts 21 and 22 may be driven by shafts rotating their respective pulleys 73 and 74. The shafts are connected to a drive means comprising a motor 78 whose output is passed through a variator 79 and connected to the shafts for the pulleys 73 and 74 by a clutch 80. By utilizing a speed variator 79, the speed of advance of the conveyors 21 and 22 may be adjusted relative to the speed of advance of the conveyors 1 and 2 of introducing means 77 so that a slight ventilation or expansion between adjacent box blanks 3 of the flow 71 in the track means 72 will be accomplished. Operation of the clutch 80 is preferably controlled through a control means 81 which will disengage the clutch 80 in response to certain signals including signals from the sensing devices 17 and 18.

To count the blanks held in the flow 71 in the track means 72, a counting head generally indicated at 28 is moved from a first position adjacent the second end of the track means in a direction opposite to the direction 4. The counting head 28 is connected to a support 32 by at least one connecting rod or link 33 which is pivotably connected to the counting head at 34 and to the support at 35. The support 32 is received for sliding movement on an axle or rod 36 of the main frame and is moved in the direction opposite to the arrow 4 by a moving means which includes a motor 29. The motor 29 is connected in driven relation to a pulley 30 by a two-speed transmission having a clutch (not illustrated). A pull cable 31 is connected to the support 32 and wound on the pulley 30. Thus, when the motor 29 is connected to the pulley 30 by the control means 81 causing the clutch to be engaged, the support 32 will be moved along the rod 36 in the direction opposite to the arrow 4 and against a spring arrangement 37 having a compression spring 38 to move the counting head 28 in a direction opposite to direction 4.

If any of the box blanks such as box blanks 3a in the flow 71 are misaligned, a counting of the blanks in the flow may be adversely effected. In order to ensure that all of the blanks 3 in the flow 71 are in the proper alignment, the device 70 includes a striking and realigning device 39. As illustrated, the striking and realigning device includes a shoe or foot member 40 which is attached to a reciprocating means such as a pneumatic piston 41 which is secured to a cross member or bar 42 of the sub-frame 13. The device 39 includes sensing means comprising a sensor 43 having a blade 44 that rubs against an upper edge or surface of the flow 71. While in the position illustrated or when shifted to an upper position such as by engaging of the blanks 3a, the sensor 43 through a rod 45 holds a contact of a control switch 46 in a closed position. The switch 46 when closed causes the reciprocating means to be actuated by applying bursts of air from a source to the piston 41. When actuated, the piston 41 imparts a quick up and down motion to the member 40 to urge the blanks back into proper alignment. In the event the blade 44 is shifted downwards due to either an absence of blanks or a tilting of blanks from the upright position, the piston is locked in the lowermost position with the shoe member 40 engaging the edges of the upright blanks 3. Since the conveyors 21 and 22 are still moving, the foot or shoe member 40 applies a braking force to the flow to help move the blanks back to the desired vertical position. As the blanks assume the correct position sensed by movement of the blade 44 to either the plane of the edges of the blanks 3 or above the plane 3, the switch 46 interconnects the bursts of air to the piston 41 to cause the resuming of the striking motion. During the counting phase, control means 81 through an appropriate control deactivates the reciprocal movement of the reciprocating means so that the shoe member 40 is held in a position engaging the upper edges of the blanks of the flow 71. This engagement applies a braking force which prevents the addition of additional boxes by the introducing means 77 from changing the spacing between the individual blanks of the flow 71 in the track means 72. While only one striking and realigning means 39 is illustrated, additional means may be provided to act on the side edges of the blank 3 in the flow 71.

At the second end of the track means, a separating means or device is provided. The separating device includes a separating blade 47 which is movable between a first position blocking the discharge of the flow from the track means (see FIG. 2) and a second position (FIG. 3) withdrawn from the path of the flow 71 to allow discharge of the blanks. To shift the blade 47 of the separating means between the two positions, shifting means such as an actuator 82 is provided. The actuater 82 is connected to the control means 81 which controls the operation of the actuater 82.

To receive a batch such as 49 of the separated blanks 3, the apparatus includes receiving means which is illustrated as including a movable stop 48. The movable stop 48 is urged in a direction opposite to the arrow 4 and the flow 71 of blanks passed the raised separating blade 47 will urge the stop 48 in the direction 4.

To determine when the counting head 28 is in a first position adjacent the separating blade 47, a sensing means or device such as switch 50 is mounted on a frame member 51 of the main frame. When the head 28 is in the first position, the support 32 engages the sensing means and closes the switch 50. With the closing of the switch 50, the control means 81 will energize an electromagnet 52 mounted on the frame which magnet acts on a plate 52 of the support 32 to hold the head 28 in the first position.

Preferably, additional sensing means such as switches 54 and 55 are mounted on the member 51 in spaced positions. The switch 54 is engaged by the support 32 as the counting head 28 approaches the end of the counting cycle. When engaged by the support 32, the switch 54 creates a signal which is received by the control means 81 and is used to shift the two-speed transmission of the means for moving the counting head from a higher speed to a slower speed so that the counting of the last few blanks of a batch is accomplished at a lower speed. In a similar manner, the switch 55 is spaced inward of the switch 50 and is engaged by the support 32 as the counting head 28 and the counted batch are being moved in the direction of arrow 4. When engaged by the support, the switch 55 applies a signal to the control means 81 which will then decrease the speed of advance of the conveying belts 21 and 22 prior to the counting head 28 reaching the first position. The changing of the speed of advance may be accomplished either by the variator which includes a two-speed transmission or by a two-speed transmission in the drive between the motor 78 and drive pulleys 73 and 74.

Figure 5:
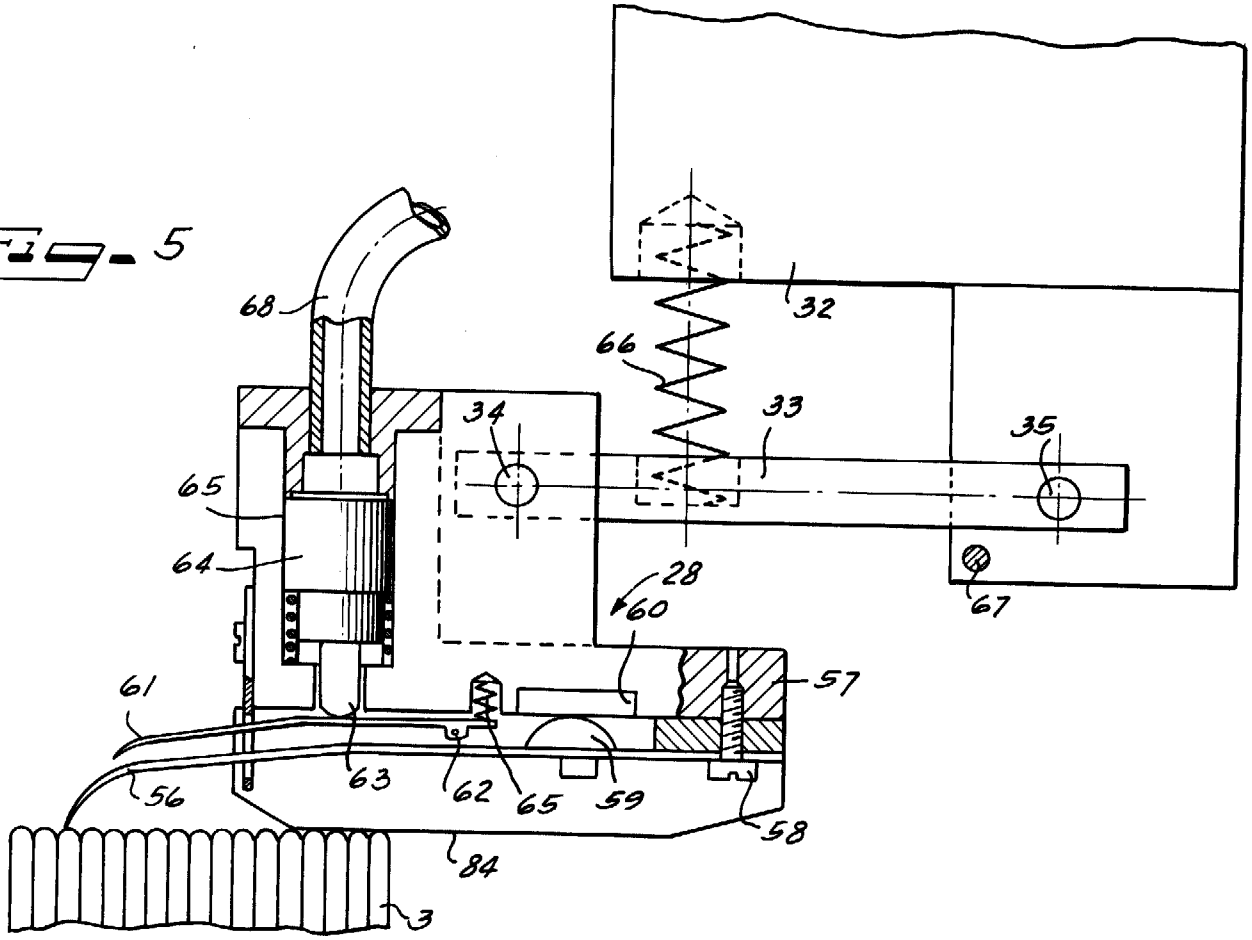
FIG. 5 is an enlarged side view with portions broken away and in cross section of the counting head in accordance with the present invention.

As best illustrated in FIG. 5, the counting head 28 has a flexible counting blade or finger 56 which is attached to the body 57 of the head 28 by a fastener such as the screw 58. The flexible blade 56 is provided with a protruberance or projection 59 which engages a surface of a piezoelectric transducer 60. The output of the transducer 60 is connected by lines not illustrated to conventional means for determining a count and which creates a signal when a predetermined count has been achieved. The means for determining the count from the output of the transducers 60 may be disposed either in the head 28 or in the control means 81. In addition to the flexible counting blade 56, the head 28 includes a holding means which includes a rigid blade 61 pivotably connected to the head at 62 and urged against a rod 63 of a pneumatic piston 64 by a compression spring 65. The piston 64 is received in a cylinder 65, which is formed in the head 28, and the head 28 has a connection with a tube or conduit 68 which extends to a source of air pressure (not illustrated) and which tube 68 will apply the air pressure on the piston 64. When the holding means is actuated, air pressure acts on the piston 64 to force the rigid blade 61 against the flexible blade 56. With the rigid blade 61 urged against the blade 56, the free end of the blade 56 will be held in a position below the plane of the upper edges of blanks and between blanks 3' and 3'' (see FIG. 3).

As mentioned above, the head 28 is pivotably attached by connecting rod 33 to the support 32. To urge a bottom surface 84 of the head 28 onto the upper edges of the blanks 3, a compression spring 66 acts between the support 32 and the connecting rod 33. To limit the downward movement of the rod 33, a stop pin such as 67 may be provided.

The device 70 operates in the following manner. At the beginning of the counting phase, the blade 47 of the separating device is in the first position and prevents discharge of the blanks 3 from the track means, the counting head 28 is in the first position with the free end of the counting blade 56 in contact with the blade 47, the conveyor belts 21 and 22 are stopped by the control means 81 disengaging the clutch 80 and the shoe member 40 is held in the lower position engaging the edge of the flow 71. The control means 81 engages the clutch for the means for moving the counting head 28 so that the motor 29 will rotate the pulley 30. As the pulley is rotated, the support 32 is moved in a direction of arrow 86 which is opposite to the arrow 4. This movement causes the counting head 28 to be moved along the flow 71 which is held stationary between the stationary conveyor belts 21 and 22. As the free end of the blade 56 moves over each of the blanks 3, the oscillations of the blade are converted by the piezoelectric transducer into counting pulses which will be counted in a conventional manner. After the support 32 and head have traveled along the flow 71 for a given distance, the support 32 engages switch 54 which applies a signal to the control means 81 and the control means 81 will cause the means for moving to reduce its speed of advance in the direction of arrow 86. The position of switch 54 is selected so the reduced speed occurs before counting of the last few blanks of the batch and enable an improved accuracy in the obtaining of an exact count.

Figure 3:
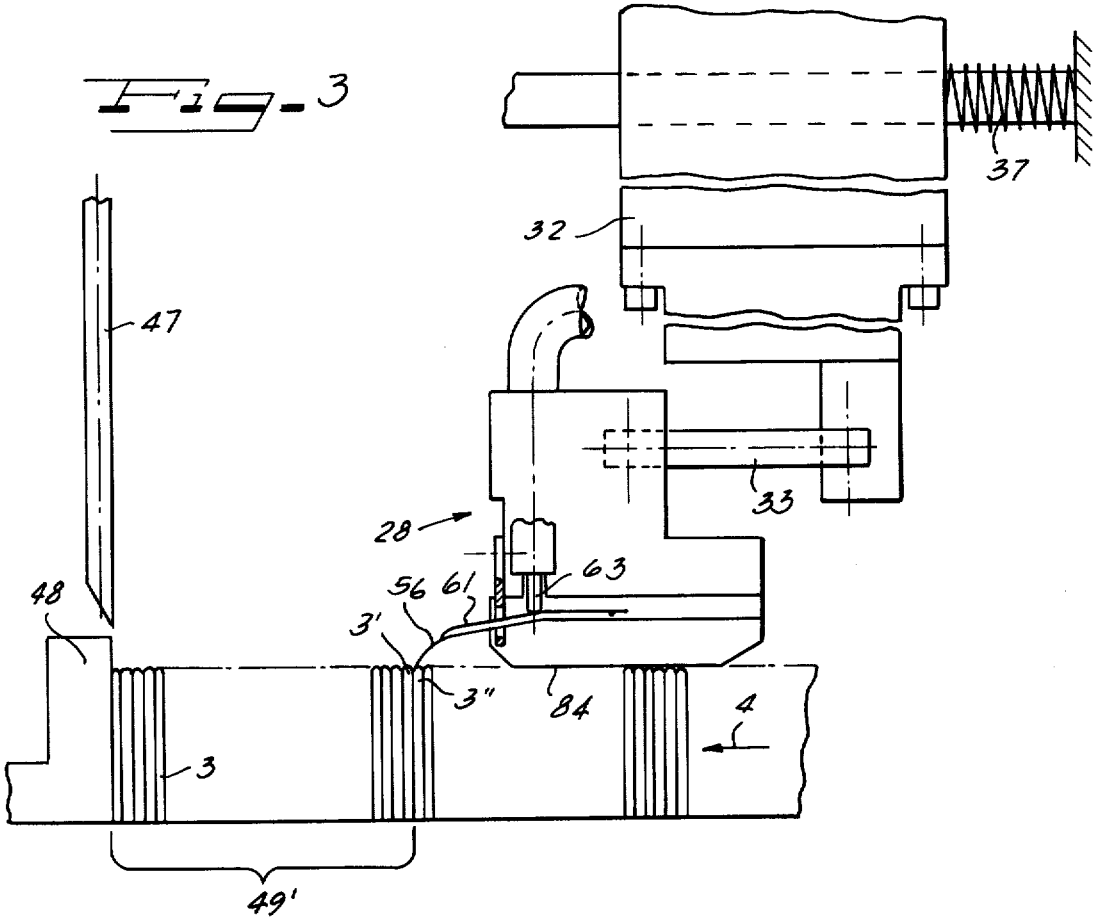
FIG. 3 is a partial view of the counting means and the separating device at the beginning of conveying of the bath of counted blanks from the track means.

When a predetermined number of pulses is reached which will occur when the blade passes over a predetermined number of blanks 3 with the last blank being 3' (FIG. 3), the control means 81 will simultaneously actuate the holding means and disengage the clutch of the moving means to disengage the pulley 30 from the drive of the motor 29. When the holding means is actuated, the piston 64 forces the stiff blade 61 against the flexible blade 56 to force the curved free end of the blade 56 between the last counted blank 3' of the newly counted batch 49' and the following blank 3" which will become the first blank of the next batch to be counted. With the release of the clutch of the moving means, the spring 38, urges the support 32 and head 28 in the direction of arrow 4 which facilitates insertion of the curved free end of the blade 56 between the blanks 3' and 3". In addition to actuating the holding means and deactuating the moving means, the control means 81 will engage the clutch 80 for the drive means on the conveyors 21 and 22, energize the actuator 82 to raise the blade 47, and actuate the reciprocating means of the striking and realigning device 39. Since the previously formed batch had been removed, the movable stop 48 will engage the first blank in the new batch 49' as illustrated in FIG. 3.

Figure 4:
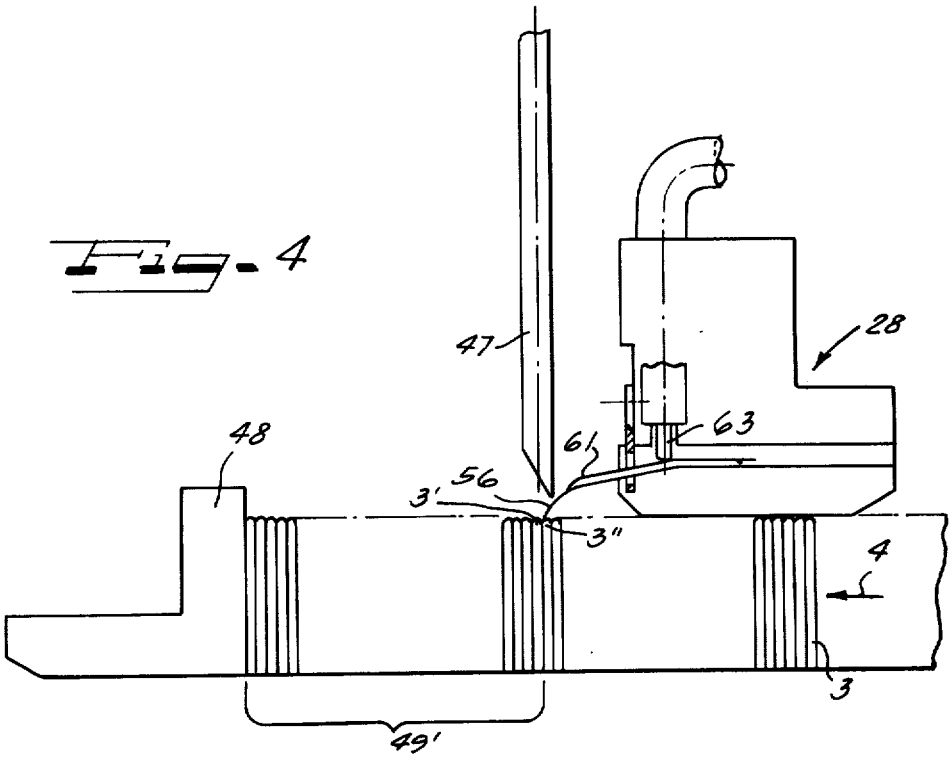
FIG. 4 is a partial view of the separating means with the counting means in the first position prior to separating the batch of counted blanks.

Movement of the conveyor belts 21 and 22, will shift the newly counted batch 49' in the direction of arrow 4 to shift the movable stop 48 toward the position illustrated in FIG. 4. With the moving of the conveyor belts 21 and 22, the introducing means 77 will introduce an additional portion of the flow 71 to the first end of the track means and the newly introduced blanks of the flow will be subjected to the striking and realigning device 39. While the drawings only illustrate a device acting on the upper edges, additional devices may be used to act on one or more side edges.

As the conveyors 21 and 22 move the counted batch 49' for discharge through the second end, the head 28 will move along with the batch toward the first position. When the switch 55 is tripped, the signal gennerated is generated by the control means 81 which will reduce the speed of advance of the conveyor belts 21 and 22. This can be accomplished either with variator 79 or by a two-speed transmission disposed in a drive train between the clutch 80 and the motor 78. The conveyor belts 21 and 22 will continue to move the flow 71 in the direction of arrow 4 until the sensing means or switch 50 is tripped which will occur when the counting means assumes the first position with the free end of the blade 56 disposed in the path of the separating blade 47 (see FIG. 4). With the tripping or actuation of the switch 50, the control means 81 will energize the electromagnet 52, disengage the clutch 80, actuate the means for shifting the blade 47 to the first position and disengage the holding means on the head 28. In addition, the reciprocating means such as the piston 41 of the device 39 is deactivated so that the shoe 40 is held in engagement with the edges of the blanks forming the flow 71. With the movement of the blade 47 from the position illustrated in FIG. 4 to the first position, the blade will pass between the last blank 3' of the batch 49' and the following blank 3" to separate the batch (see FIG. 2) from the flow 71. The position of the free end of counting blade 56 aids in guiding the separating blade 47 to move between the blanks 3' and 3". With the blade 47 in the first position, the counting phase is repeated to count a following batch of blanks 3. During the counting process of the blanks 3 forming the next batch, the separated batch 49 is removed by appropriate means so that the movable stop 48 can shift back into engagement with the first blank of the new batch.

Since the flow in the track means 72 is held in a substantially stationary position during the counting phase and since the introducing means 77 is continually adding new blanks to create the flow, the movement of the pressing means 5 on the slide 12 will allow increasing the length of the flow 71 in the means 77 while the flow in the track means is being held in a stationary position. If during the step of introducing the flow from the introducing means 77 into the track means 72, the blanks of the flow tend to move from an upright position to a position such as illustrated at 19, the safety switches or sensing means 17 and 18 will stop the movement of the conveyor belts 21 and 22 so that the blanks can be returned to the upright or vertical position.

As mentioned, the present invention enables obtaining an accurate count of the number of blanks 3 in each batch 49 and the separation of the batch from the flow 71. In addition, the number of blanks in each batch can be adjusted by simple adjustments of the counting means which may be a conventional electronic counter. It should be noted that when the count of the batch is changed, adjustment in the position of the locking ring 15 and the position of the sensing means such as 54 may be required.

Although various minor modifications may be suggested by those versed in the art, it should be understood that we wish to employ within the scope of the patent granted hereon, all such modifications as reasonably and properly come within the scope of our contribution to the art.

We claim:

1. A method for counting a predetermined number of folded box blanks which are disposed on edge in a continuous flow and for separating the predetermined number of box blanks from the flow as a batch, said method comprising providing track means for receiving and supporting a flow of folded box blanks disposed on their edges and having a first and second end, a separating device at the second end of the track means and movable from a first position extending across the second end to prevent discharge of box blanks therefrom and a second position enabling discharge of box blanks, a counting head having means including a counting blade for counting folded box blanks and creating a signal; introducing a flow of box blanks to the first end of the track means; positioning the separating means to prevent discharge of box blanks from the second end; moving the counting head from a first position adjacent the separating device toward the first end to sequentially count blanks in the flow contained therein; stopping movement of the counting head when a predetermined number of box blanks has been counted; holding the blade of the counting means between the last counted blank and next following blank; moving the separating means to the second position; moving the flow in the track means with the counting head moving therealong to discharge the counted blanks as a batch from the second end; stopping the moving of the flow as the counting head reaches the first position; moving the separating means to the first position extending between the last counted box blank and the next following blank to separate the batch from the flow, releasing the blade and moving the counting head toward the first end to count the next succeeding batch of blanks.

2. A method according to claim 1, wherein the step of introducing the flow of box blanks includes creating the flow of box blanks by erecting blanks in a shingle-wise formation into the flow of blanks on an edge.

3. A method according to claim 1, which further includes sensing the position of the blanks in the flow being introduced at the first end and correcting the position of the blanks.

4. A method according to claim 3, wherein the step of sensing and correcting the position includes reciprocating a shoe member against the edges of the blanks to move them to the aligned positon and holding the shoe member against the blanks during the step of counting.

5. A method according to claim 1, which includes the step of sensing a given distance of movement of the counting head from the first position and slowing the speed of movement during the last portion of the counting step.

6. A method according to claim 1, wherein the step of moving the counting head towards the first position includes sensing the counting head at a point of a predetermined distance from said first position and slowing the rate of movement after sensing the head at said point.

7. An apparatus for counting a predetermined number of folded box blanks which are disposed on edge in a continuous flow and for separating the predetermined number of box blanks from the flow as a batch, said apparatus comprising a frame; track means disposed in said frame for receiving and supporting the flow of folded box blanks, said track means having a first and second end and including means for conveying the flow along the track means from the first to the second end; means disposed in the frame for introducing the flow of folded box blanks disposed on an edge into the first end of the track means; means disposed at the second end to receive the batch of box blanks; a separating device disposed at the second end of the track means; means for shifting said separating device between a first position extending across the second end to prevent discharge of the box blanks into the means for receiving and a second position enabling discharge of the blanks from said second end; a counting head having means including a counting blade for counting the folded box blanks and creating a signal, and means for selectively holding the blade between two blanks; means for supporting said counting head for movement along said track means from a first position adjacent the second end with an end of the blade in the path of the separating device to a second position displaced toward the first end of the track means; means for moving the counting head on said means for supporting; sensing means on the frame for creating a signal when the counting head is in said first position; and control means for receiving the signals from the counting means and the sensing means and actuating the means for shifting, the means for conveying, the means for moving and the means for holding in response to the particular signal received so that with the separating device in said first position and said means for conveying being deactuated, the counting head is moved from the first position toward the second position to count the blanks in the track means; when said predetermined number of blanks is counted, the control means actuates the holding means, deactuates the means for moving, causes the means for shifting to move the separating device to the second position, and actuates the means for conveying to move the counted blanks as a batch passed the separating device; and when said counting head arrives at said first position, said control means deactivates the means for conveying, causes the means for shifting to move the separating device to the first position to separate the batch of counted blanks from the flow, and deactuates said holding means.

8. An apparatus according to claim 7, wherein the means for introducing includes means for erecting blanks in a shingle-wise arrangement into the flow of folded box blanks disposed on an edge.

9. An apparatus according to claim 8, wherein the means for introducing includes at least a pair of conveyor belts with each pair having an upper belt engaging an upper edge of the flow and a lower belt engaging the lower edge, and wherein said means for erecting include a pressing device engaging the upper belt to deflect the path below the upper edge of the erected blanks.

10. An apparatus according to claim 7, which includes means for sensing the position of blanks in the flow as the flow is introduced into the first end of the track means and means for correcting the position of the blanks in response to the sensing means.

11. An apparatus according to claim 10, wherein the means for correcting includes a shoe member and means for reciprocating the shoe member against the edges of the flow of blanks in response to the sensed position.

12. An apparatus according to claim 11, wherein said control means deactivates the reciprocating means to hold the shoe member in engagement with the edges of the flow as the counting head is moved from the first toward the second position.

13. An apparatus according to claim 11, wherein said means for reciprocating comprises a pneumatic piston and said means for sensing controls the flow of air to said piston.

14. An apparatus according to claim 7, wherein the means for conveying comprises at least an upper and a lower conveyor belt, said upper and lower conveyor belts being driven from a main drive source simultaneously through a speed variator and clutch so that the speed of the belts of the conveying means may be adjusted relative to the means for introducing the flow to the track means.

15. An apparatus according to claim 7, which includes a second means for sensing the position of the counting head at a point adjacent the first position and between the first and second positions, said second sensing means creating a signal, said control means decreasing the speed of the means for conveying when receiving the signal from the second sensing means so that as the counting head approaches the first position, the speed of the conveying means is decreased.

16. An apparatus according to claim 7, wherein said means for supporting said counting head includes a support movable on said frame, a connecting rod extending from said support to the counting head.

17. An apparatus according to claim 16, wherein a spring is disposed between the connecting rod and movable support to bias the counting head toward the upper face of the flow of boxes in said track means.

18. An apparatus according to claim 7, which includes a third sensing means disposed on the frame for determining the arrival of the counting head at a third point adjacent to the second position and between the first and second positions, said third sensing means creating a signal when the counting head reaches said third position and wherein said control means reduces the speed of the means for moving the counting head when the signal from the third sensing means is received so that the counting of the last box prior to the predetermined box is accomplished at a reduced speed.

19. An apparatus according to claim 7, wherein the means for supporting the counting head includes a movable support coupled to the counting head by a connecting rod, and wherein the means for moving the counting head includes a spring biasing the movable support toward the first position, a motor connected by a two-speed reduction device to a pulley with a clutch interposed therebetween, a traction cable having one end attached to the movable support and the other end attached to the pulley so that movement of the pulley winds up the cable to move the support against the force of the spring and said control means stops the means for moving by disengaging said clutch.

20. An apparatus according to claim 19, wherein movable support means is mounted on at least one axle disposed in the frame and extending parallel to an upper plane of the flow of folded boxes in the track means.

21. An apparatus according to claim 19, which includes sensing means for determining movement of the movable support passed a given point, said sensing means creating a signal causing the two-speed reduction to shift to a lower speed for winding the pulley.

22. An apparatus according to claim 7, wherein said counting blade is a flexible blade rigidly connected at one end to the counting head, said flexible blade having a protruberance in contact with a piezoelectric transducer whose output is connected to the counter means so that oscillations of the flexible blade causes the piezoelectric transducer to create counting pulses.

23. An apparatus according to claim 22, wherein the holding means includes a stiff blade pivotably mounted on the counting head, a pneumatic piston having a rod and a spring holding the stiff blade against said rod.

24. An apparatus according to claim 23, wherein the pivotable connection is disposed between the point of the blade engaged by the rod and engaged by said spring.

25. An apparatus according to claim 23, wherein the control means actuates the pneumatic piston to press the stiff blade against the flexible blade in order to hold the end between the blanks.

* * * * *